US007147442B2

(12) United States Patent
Yeh

(10) Patent No.: US 7,147,442 B2
(45) Date of Patent: Dec. 12, 2006

(54) AUTOMATIC OIL PUMP, WITH A VALVED PUMPING PISTON AND A VALVED DRIVING PISTON UNIT

(76) Inventor: Kuo-Chung Yeh, No. 43-2, Wa Tsuo, Kuo Kou Community, Tai Bao City, Jia Yi Chien (TW)

( * ) Notice: Subject to any disclaimer, the term of this patent is extended or adjusted under 35 U.S.C. 154(b) by 275 days.

(21) Appl. No.: 10/444,024

(22) Filed: May 22, 2003

(65) Prior Publication Data

US 2004/0234390 A1 Nov. 25, 2004

(51) Int. Cl.
*F04B 17/00* (2006.01)

(52) U.S. Cl. ..... 417/399; 417/400; 417/545; 417/552; 91/226; 91/321

(58) Field of Classification Search ..... 417/399, 417/400, 545, 552; 91/226, 321, 222
See application file for complete search history.

(56) References Cited

U.S. PATENT DOCUMENTS 2,406,747 A * 9/1946 Davis ..... 91/321
2,943,576 A * 7/1960 English ..... 417/377
3,597,121 A * 8/1971 McClocklin ..... 417/400
3,695,785 A * 10/1972 Vanderlaan ..... 417/400
3,726,185 A * 4/1973 Orr ..... 91/290
4,352,644 A * 10/1982 Landrum et al. ..... 417/402
5,203,857 A * 4/1993 Terwilliger et al. ..... 417/552
5,341,723 A * 8/1994 Hung ..... 91/224
5,683,230 A * 11/1997 Karppinen ..... 417/397
6,497,560 B1 * 12/2002 Carlson ..... 417/553

FOREIGN PATENT DOCUMENTS

JP 2261911 A * 10/1990

* cited by examiner

*Primary Examiner*—Charles G. Freay
*Assistant Examiner*—Emmanuel Sayoc
(74) *Attorney, Agent, or Firm*—Alan D. Kamrath; Nikolai & Mersereau, P.A.

(57) ABSTRACT

An automatic oil pump includes a drive chamber, having a reciprocal driving device, and an oil chamber, having a sucking device, located on two sides of a main body. The reciprocal driving device has a piston unit having a valve chamber at its center and a balance valve and is pushed by a spring. The drive chamber has grooves on its inside wall. The piston unit has two channels, allowing air to flow into the valve chamber past two sides of the piston unit. On the piston unit is a driving rod. The driving rod penetrates into the main body and reaches into the oil chamber. A hermetic cover and a movable piston are attached to an end of the driving rod. On the wall of the piston are pluralities of through holes. The reciprocal driving device drives the piston in the oil chamber to move reciprocally, so oil is sucked into and out of the oil chamber continuously. Thereby, oil sucking speed and volume are upgraded to save time and labor, and oil pumping efficiency is enhanced.

8 Claims, 8 Drawing Sheets

AUTOMATIC OIL PUMP, WITH A VALVED PUMPING PISTON AND A VALVED DRIVING PISTON UNIT

BACKGROUND OF THE INVENTION (a) Field of the invention

The present invention uses a pneumatic device to drive a reciprocal driving device installed at one side of a main body and in turn driving a driving rod to enable reciprocal movement to a pumping device installed in an oil chamber at another side of the main body, with a sucking tube attached to a lower part of the main body reaching into an oil tank, thereby sucking oil into and out of the oil chamber.

(b) Description of the Prior Art

As shown in FIG. 9, the conventional manual type of oil pump includes an oil sucking tube 81 attached to a lower part of a main unit 8, a one-way valve installed inside the oil sucking tube 81, an oil discharge tube 82 attached to an upper part of the main unit 8, and a handle 83 attached to one side of the main unit 8. The inside of the main unit 8 is separated into two compartments, one containing a labor-saving gear set, another containing two sets of pump gears 84 in mesh (also shown in FIG. 10). When the handle 83 is turned, the labor-saving gear set is driven to rotate, which in turn drives the two pump gears 84 to rotate, creating a negative pressure inside the space below the two pump gears 84 and the sucking tube 81. The sucking tube 81 reaches inside the oil tank and can suck up the oil to pass between the two pump gears 84 before it is squeezed and discharged from the discharge tube 82.

Such oil sucking mechanism has the following shortcomings:

1. Manually turning the driving pump gear 84 costs time and labor, and cannot satisfy the requirements of high efficiency in liquid sucking speed and volume.
2. Generally excellent and close sliding contact must be maintained between the two sides and tooth surfaces of the pump gear 84 with the inside wall of the main unit 8. Extended wear and tear between the pump gear 84 and the main unit 8 will create a large clearance, resulting in backflow of oil and unsatisfactory oil sucking efficiency.

SUMMARY OF THE INVENTION

To address the problems of labor, time, poor efficiency and possible backflow due to wear and tear in conventional, manual type oil pumps, the present invention has designed a pneumatic automatic reciprocal driving device at one side of a main body and driving a piston having a sucking device installed at another side of the main body and moving reciprocally inside a pumping chamber. A sucking tube is attached to a lower part of the main body and extended into oil. Oil will be pumped into the oil chamber before the piston pumps the oil out, thereby achieving high efficiency in oil pumping speed and volume in time-saving and labor-saving operation.

The foregoing reciprocal driving includes a piston unit that has oil rings on two sides and a recess groove intermediate the oil rings. The piston unit is installed inside the drive chamber on one side of the main body and is pushed by a spring. One end of the piston unit is attached with a driving rod penetrating into the main body. At a specified position on the inside wall of the drive chamber are grooves having a slightly larger width than the oil seals, At the inside center of the piston unit, a valve chamber is installed having a movable post valve. A valve gate at one end of the post valve is capable of sealing the valve opening of the valve chamber. On the piston unit at the valve opening is a channel having an open end. On the piston unit is a through hole communicating between the recess groove and the valve chamber. At the bottom of the drive chamber is a vent hole communicating to the outside. By continuously feeding compressed air into the drive chamber ,the piston unit is pushed back to the end. When the oil seal at the front of the piston unit is located at the grooves on the wall of the drive chamber, compressed air is allowed to flow through the grooves, the groove and the through hole on the piston unit and into the valve chamber to push the post valve outward. Thus, the valve opening is opened permitting the compressed air to flow through the valve opening and the channel and out of the vent hole at the bottom of the drive chamber, causing a pressure loss inside the drive chamber. The piston is then pushed by the spring to return to the front of the drive chamber and is obstructed at the front wall of the drive chamber. As s result, the post valve backs up to seal the valve opening. The operation repeats itself, making the piston unit move reciprocally inside the drive chamber, and causing the driving rod to push and pull repeatedly inside the oil chamber.

One end of the aforementioned driving rod reaching into the oil chamber is attached by a guide bolt to a hermetic cover. On the guide bolt, a piston is movably installed, with the piston having through holes surrounding its side wall. The hermetic cover is capable of sealing all through holes on the piston. When the driving rod pushes forward, the hermetic cover comes close to the side of the piston to seal the through holes. The oil inside the oil chamber at the front of the piston is discharged. Meanwhile, a negative pressure is created inside the oil chamber at the rear of the piston, causing the sucking tube to suck oil into the oil chamber. When the driving rod backs up, the piston slides away from the hermetic cover, because it is obstructed by the oil. The oil at the rear of the piston is permitted to pass through the through holes and fill into the oil chamber at the front of the piston. Such repeated operation pumps oil continuously.

The advantages of the present invention will become more fully apparent by examination of the following description of the preferred embodiments and the accompanying drawings.

DETAILED DESCRIPTION OF PREFERRED EMBODIMENTS

Figure 1:
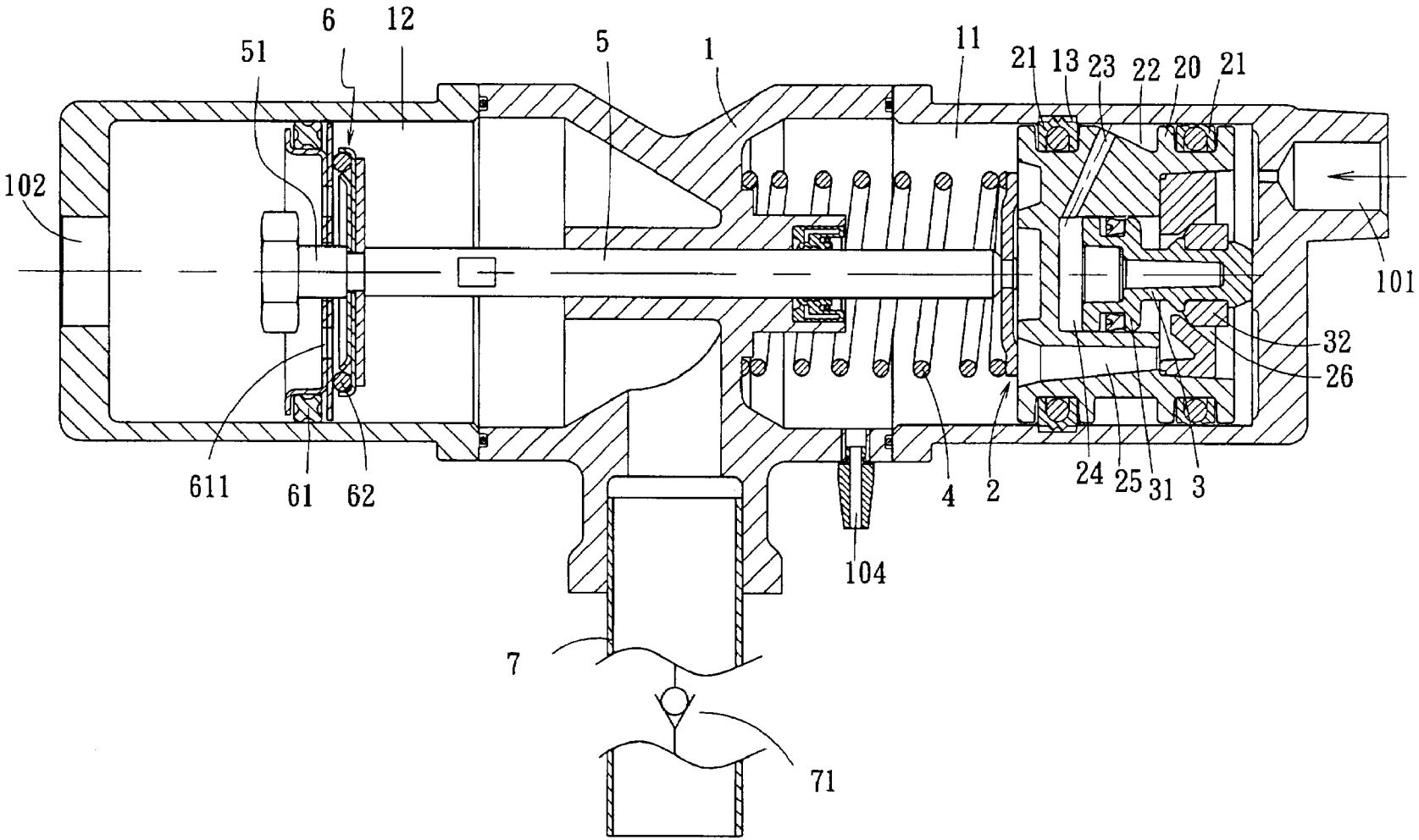
FIG. 1 is a cross sectional view of the present invention.

As shown in FIG. 1, the present invention of an oil pump includes a main body 1 containing a drive chamber 11 and an oil chamber 12 on two sides thereof. At the front of the drive chamber 11 is an inlet 101 for compressed air. At the rear of the oil chamber 12 is an outlet 102 for oil. At the lower side of the main body 1 is a sucking tube 7 leading to the oil chamber 12. On the sucking tube 7 is a one-way valve 71. Inside the drive chamber 11 is a reciprocal driving device 2. Inside the oil chamber 12 is a sucking device 6.

The reciprocal driving device 2 includes a piston unit 20 having oil seals 21 on two sides thereof and a recess 22 on the outside thereof intermediate the oil seals 21. The piston unit 20 is installed inside the drive chamber 11 on one side of the main body 1. A spring 4 is installed inside the drive chamber 11 at the rear of the piston unit 20, with the spring 4 pushing against the piston unit 20. A driving rod 5 is attached to the rear of the piston unit 20, with the driving rod 5 penetrating the main body 1 and extending into the oil chamber 12 on another side. At specified locations on the inside wall of the drive chamber 11 are grooves 13 that are slightly wider than the oil seals 21 (shown in FIG. 5). At the inside center of the piston unit 20 is a movable valve chamber 24 having a movable post valve 3, with a valve gate 32 at one end of the post valve 3 covering a valve opening 26 of the valve chamber 24. At another end of the post valve 3 is a piston part 31 that is accommodated inside the valve chamber 24. The piston unit 20 at the valve opening 26 has a channel 25 with an opened end. The channel 25 communicates with two sides of the piston unit 20 when the valve opening 26 is opened. On the piston unit 20 is a through hole 23 to permit communication between the recess 22 and the valve chamber 24. At the bottom of the drive chamber 11 is a vent hole 104 communicating with the outside.

The sucking device 6 has the driving rod 5 reaching into one end of the oil chamber 12 11,11 and a guide bolt 51 fixing a hermetic cover 62. On the guide bolt 51 is a movable piston 61 having through holes 611 distributed around a side wall thereof, with the through holes 611 on the piston 61 covered by the hermetic cover 62.

Figure 2:
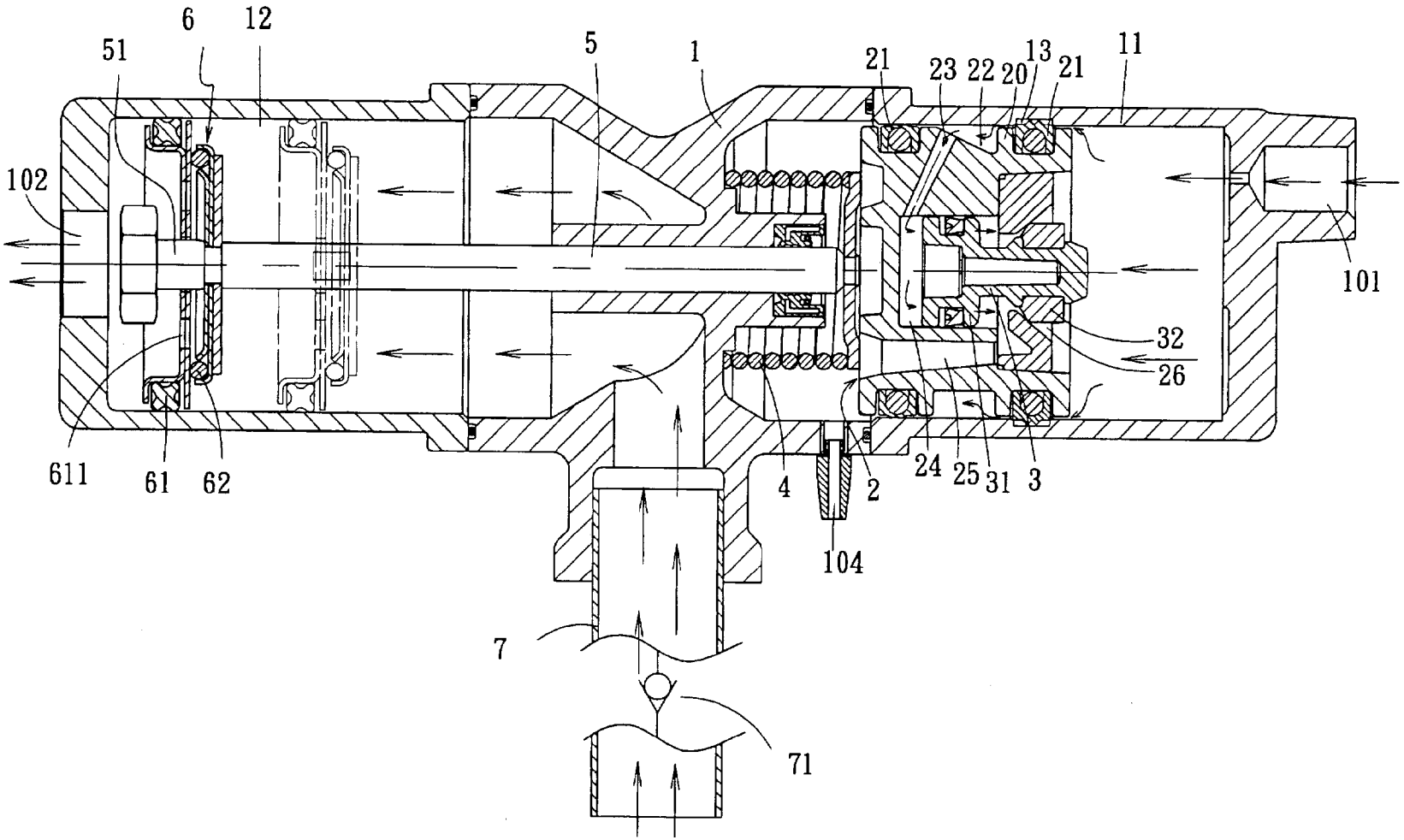
FIG. 2 is a cross sectional view of the present invention as shown in FIG. 1 in pumping operation.
Figure 3:
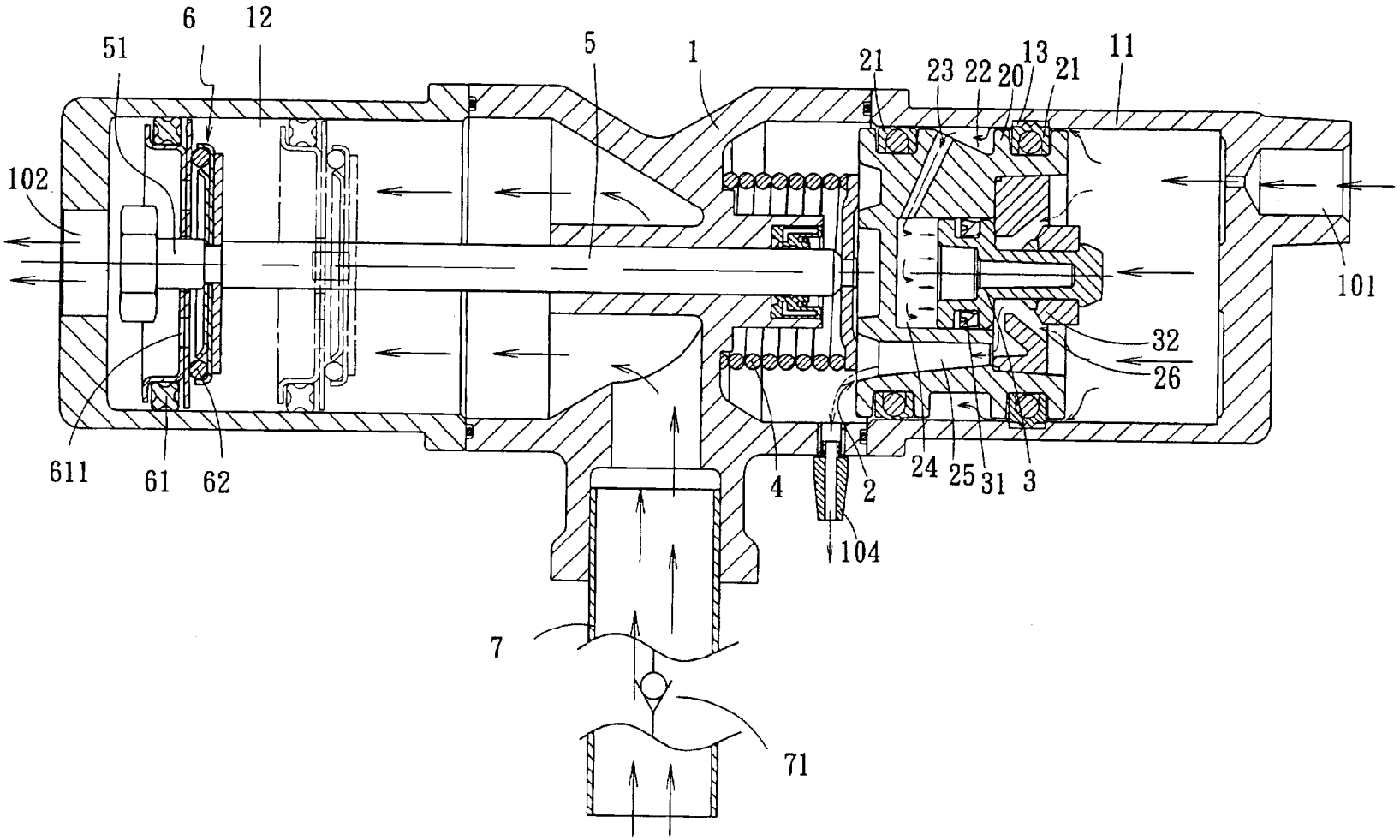
FIG. 3 is a schematic view of the valve post of the invention in operation.
Figure 4:
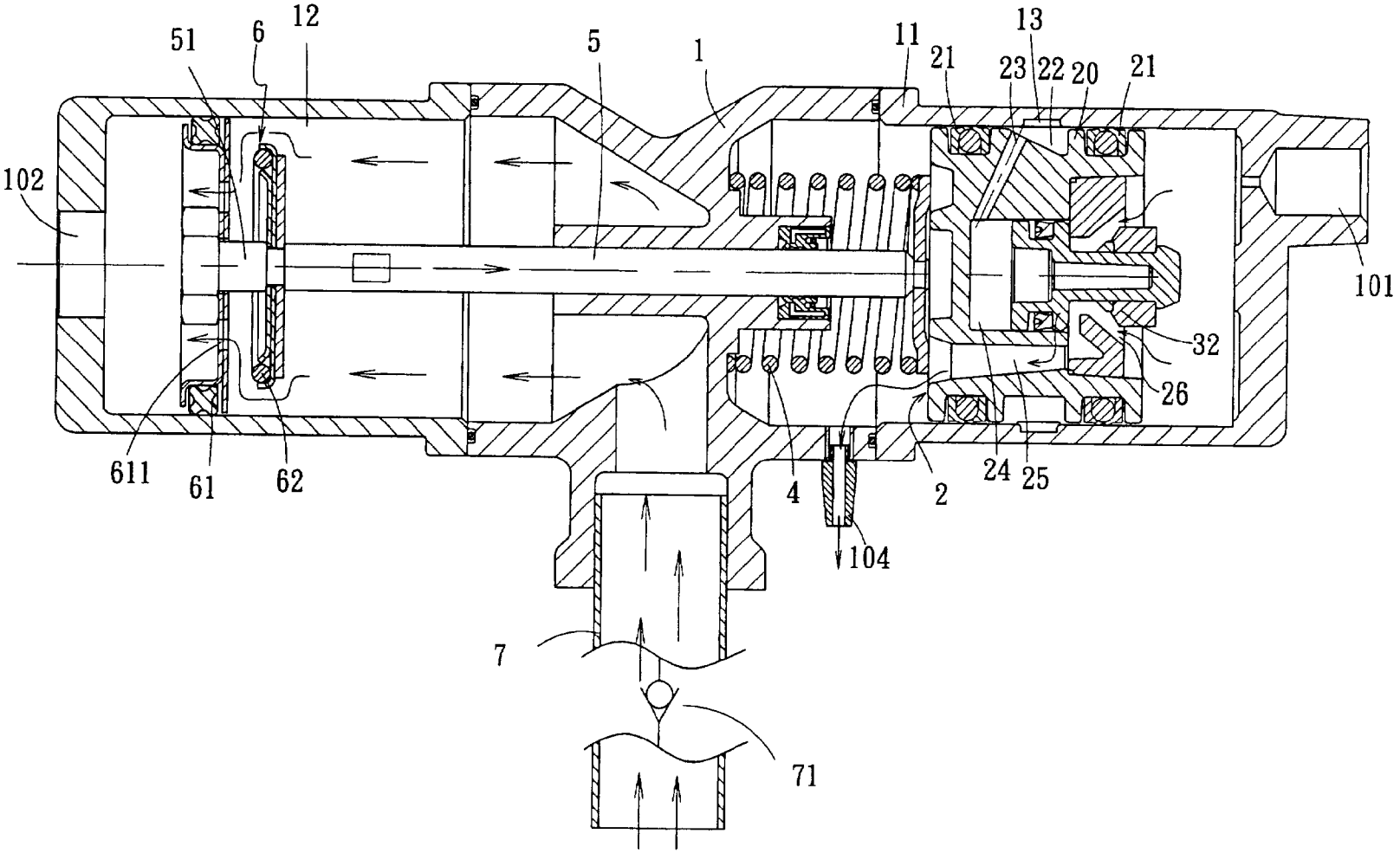
FIG. 4 is a schematic view of the invention where oil is passing the piston.

As shown in FIGS. 2, 3 and 4, when compressed air is fed continuously through the inlet 101 into the drive chamber 11, the piston unit 20 is pushed back to the rear end. Then, the oil seals 21 at the front of the piston unit 20 are moved to the grooves 13 on the wall of the drive chamber 11, allowing the compressed air to flow through the grooves 13, the recess 22 and the holes 23 on the piston unit 20 into the valve chamber 24. The post valve 3 is gushed outwardly, opening the valve gate 32 on the valve opening 26 and allowing the compressed air inside the drive chamber 11 at the front of the piston unit 20 to. flow through the valve opening 26 and the channel 25 into the drive chamber 11 at the rear of the piston unit 20, and through the vent hole 104 to the outside of the unit. A pressure loss is thereby created inside drive chamber 11 so the piston unit 20 is pushed by the spring 4 and reset to the front of the drive chamber 11. Thereafter, the front of valve post 2 is obstructed by the front wall of the drive chamber 11, backing the post valve 2 and sealing the valve opening 26. Then, the compressed air pushes back the piston unit 20, and the operation repeats itself continuously to enable continuous reciprocal movement of the piston unit 20 inside the drive chamber 11, and reciprocal pushing and pulling movement of the driving rod 5 accordingly.

The piston unit 20 continuously drives the driving rod 5 to move to and fro. When the driving rod 5 is pushed to move forward, the piston 61 on the guide bolt 51 at the end of the driving rod 5 inside the oil chamber 12 moves back to rest against the hermetic cover 62, forcing the hermetic cover 62 to cover the through holes 611 on the side of the piston 61. So when the piston 61 moves forward, a negative pressure is created inside the oil chamber 12 at the rear of the piston 61, and the sucking tube 7 sucks oil into the oil chamber 12 (shown in FIG. 2). The piston 61 moving forward also pushes oil out of the outlet 102 from inside the oil chamber 12 at the front of the piston 61. Conversely, as shown in FIG. 4, when the driving rod 5 backs up, the piston 61 is obstructed by the oil on its rear side. As a result, the piston 61 moves forward along the guide bolt 51 and disengages from the hermetic cover 62, and the through holes 611 of the piston 61 are opened, allowing oil to flow through the through holes 611 and enter the oil chamber 12 at the front of the piston 61. When the piston 61 pushes forward, the piston 61 and the hermetic cover 62 come close against each other, pushing the oil out the front of the piston 61. Driven by the driving device 2, the above operation repeats itself to pump oil out continuously.

Pneumatic driving makes a labor-saving, oil-pumping operation. As a result, oil pumping speed and volume are upgraded to achieve the requirement of high efficiency that cannot be surpassed by conventional, manual oil pumps.

Figure 6:
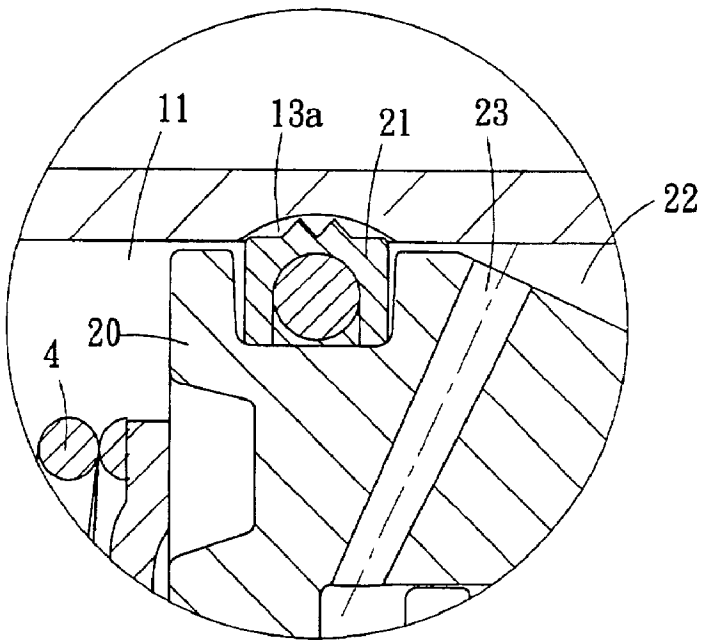
FIG. 6 is an embodiment (2) of the groove on the inside wall of the drive chamber.
Figure 5:
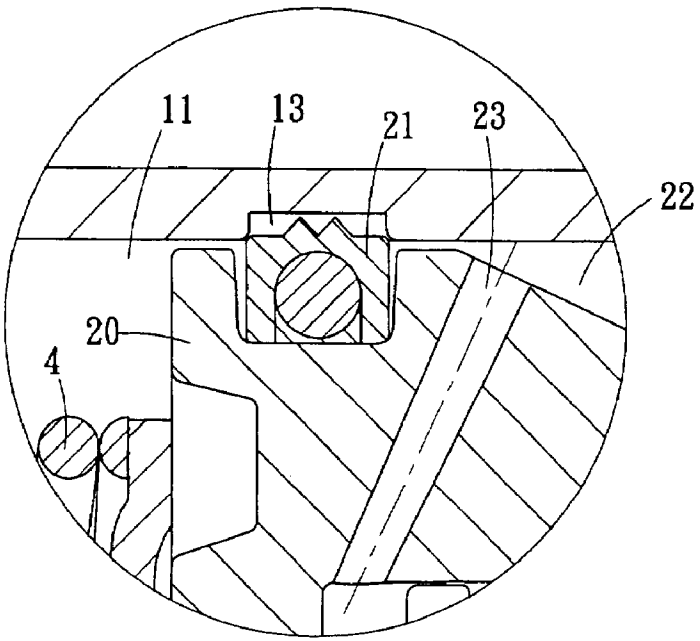
FIG. 5 is a blow-up of the grooves on the wall inside the drive chamber.
Figure 8:
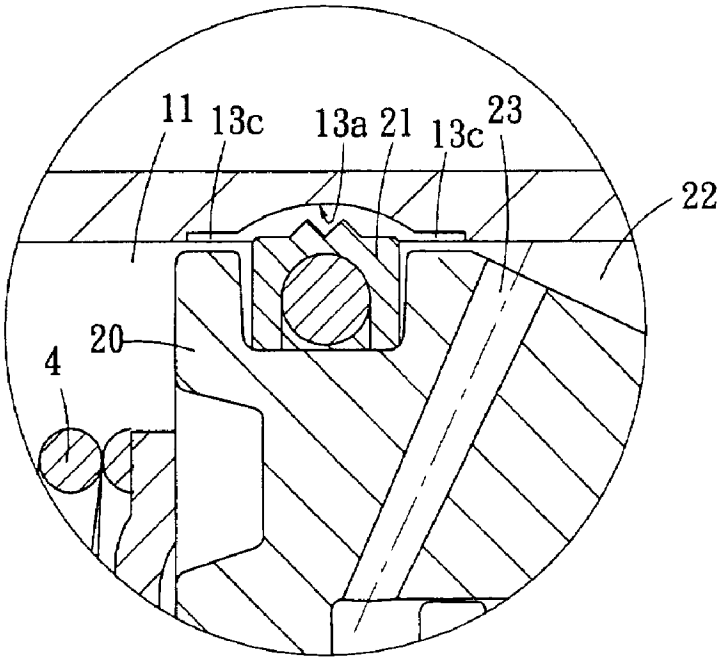
FIG. 8 is an embodiment (4) of the groove on the inside wall of the drive chamber.
Figure 7:
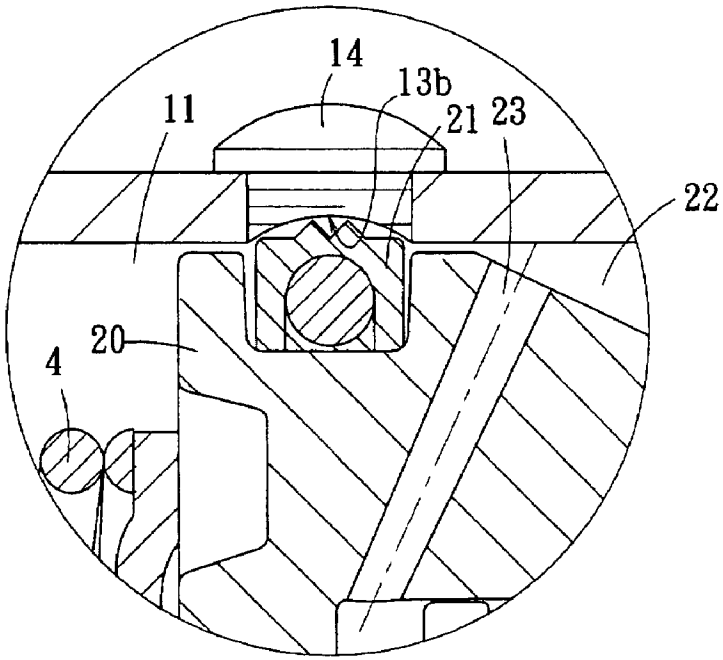
FIG. 7 is an embodiment (3) of the groove on the inside wall of the drive chamber.
Figure 9:
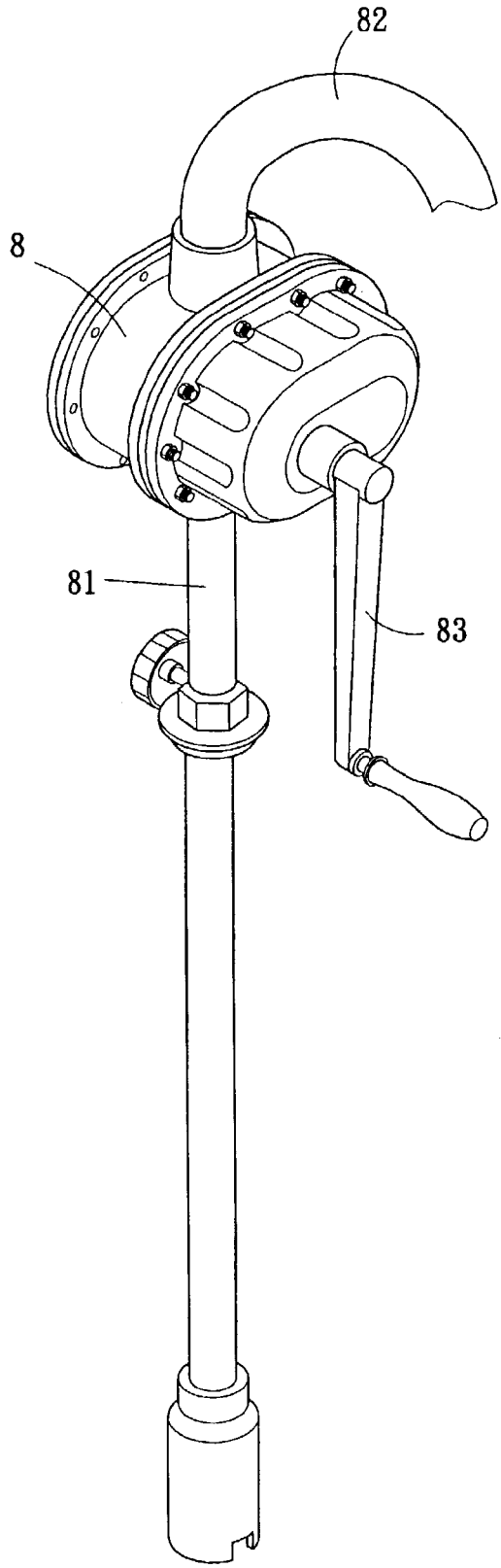
FIG. 9 is a perspective view of a conventional, manual oil pump.
Figure 10:
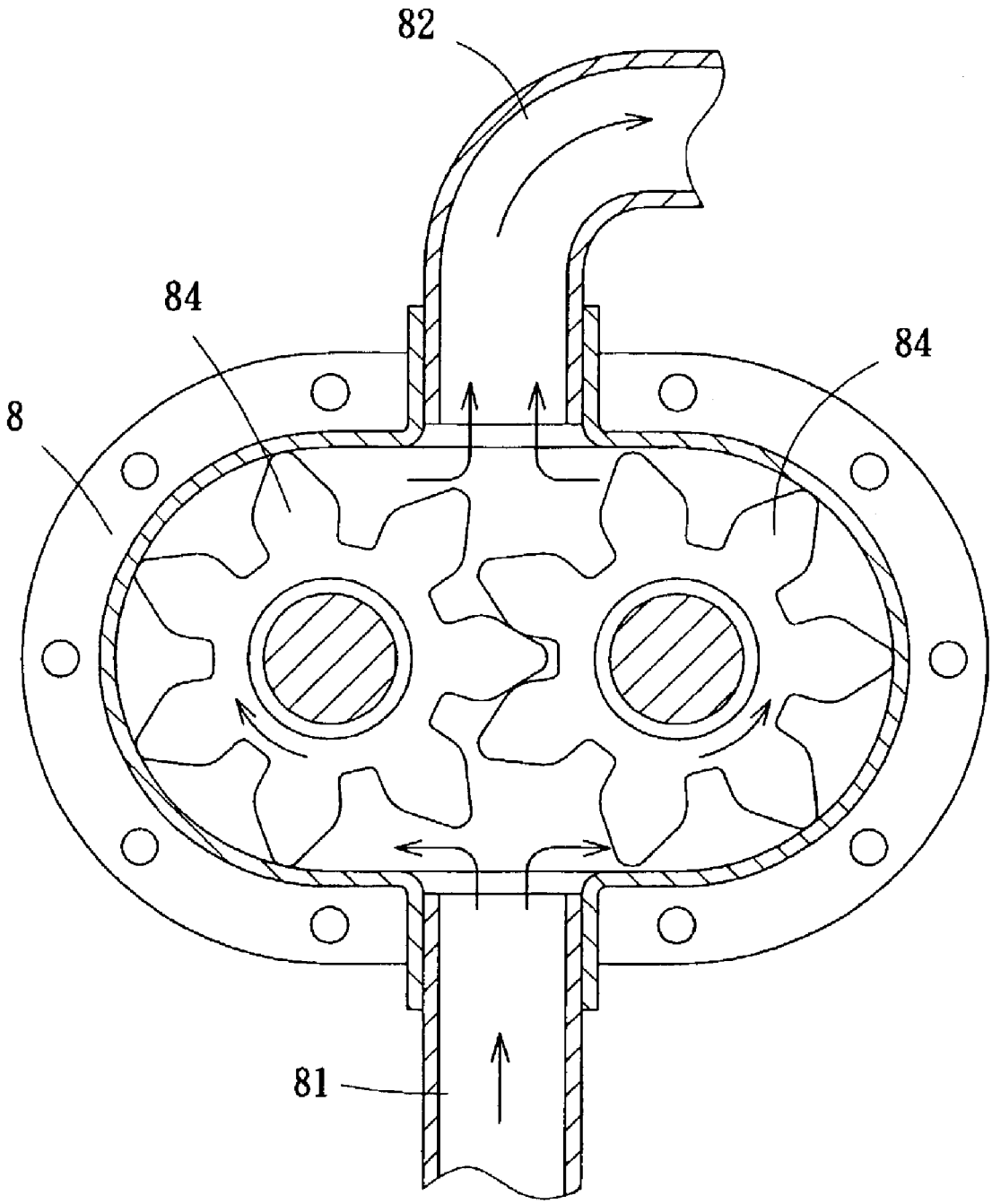
FIG. 10 is a section view of pump gear in the conventional manual oil pump.

Optionally, as shown in FIG. 6, the grooves 13 in rectangular sections in FIG. 5 are replaced by grooves 13*a* with arched sections. Likewise, grooves 13 are replaced by a plurality of screw holes drilled on the wall of the drive chamber 11 as shown in FIG. 7, with screws 14 inserted in respective screw holes having an arched part 13*b* on the end of each screw 14. Similarly, as shown in FIG. 8, grooves 13 are replaced by a shallow recess 13*c* on two side walls having the arched section of grooves 13*a* as in FIG. 6. Regardless of the changes of said grooves 13, the purpose is to permit entry of air into the recess grooves 22 when the oil seals 21 at the front of the piston unit 20 are positioned on the grooves 13.

Though the foregoing disclosure and description of the preferred embodiments of the present invention is understandable to all who are skilled in the art, it is also to be understood that modifications of shape and partial variations are included in the subject claim.

What is claimed is:

1. An automatic oil pump, comprising a drive chamber and an oil chamber installed on two sides of a main body, a front of the drive chamber having an inlet for compressed air, a rear of the oil chamber having an outlet for oil, a lower part of the main body connected to a sucking tube leading to the oil chamber, with the sucking tube having a one-way valve; a reciprocal driving device including a piston unit having oil seals on two sides thereof and a recess groove on an outside thereof intermediate the oil seals, with the piston unit being installed inside the drive chamber, a spring inside the drive chamber at a rear end of the piston unit and pushing against the piston unit; a driving rod attached to the rear end of the piston unit and that penetrates through the main body and into the oil chamber, grooves on an inside wall of the drive chamber and having a slightly larger width than the oil seals; a valve chamber at an inside center of the piston unit and having a movable post valve, with a valve gate at one end of the post valve capable of sealing a valve opening of the valve chamber; a piston part at another end of the post valve and located inside the valve chamber; opened channels on the piston unit at the valve opening and connecting two sides of the piston unit when the valve opening is opened; a first through hole on the piston unit and communicating between the recess groove and the valve chamber; a vent hole at a bottom of the drive chamber and communicating to outside of the main body; a pumping device including a hermetic cover, with the driving rod reaching into one end of the oil chamber and secured to the hermetic cover; a guide bolt attached to the hermetic cover opposite to the driving rod; a piston reciprocal on the guide bolt and having a side wall having an outer periphery in sealing contact with the oil chamber, with the side wall including through holes located spaced inwardly of the outer periphery and intermediate the outer periphery and the guide bolt, with the hermetic cover covering all through holes in the side wall of the piston; and a plurality of screw holes drilled on the wall of the drive chamber, each screw hole is inserted with a screw having an arched end defining the grooves on the inside wall of the drive chamber, thereby the piston unit of the reciprocal driving device drives the driving rod and the piston inside the oil chamber to move reciprocally, sucking oil continuously into and out of the oil chamber.

2. The automatic oil pump of claim 1, wherein the grooves on the inside wall of the drive chamber have a section of a rectangular shape.

3. The automatic oil pump of claim 2, wherein the section of the grooves on the inside wall of the drive chamber have shallower recesses.

4. The automatic oil pump of claim 1, wherein the grooves on the inside wall of the drive chamber have a section of an arched shape.

5. The automatic oil pump of claim 4, wherein the section of the grooves on the inside wall of the drive chamber have shallower recesses.

6. A pumping device comprising, in combination:

a chamber having an outlet and an inlet;

a reciprocating driving rod extending into the chamber;

a hermetic cover secured to and moveable with the reciprocating driving rod between the inlet and outlet; and a piston mounted to the hermetic cover intermediate the hermetic cover and the outlet and for reciprocal movement relative to the hermetic cover, with the piston having an outer periphery in sealing contact with the chamber, with the piston having at least one through hole located inwardly of the outer periphery and the chamber, with the piston abutting with the hermetic cover when the driving rod moves the hermetic cover towards the outlet and sealing the at least one through hole and with the piston spaced from the hermetic cover when the driving rod moves the hermetic cover towards the inlet and allowing communication through the at least one through hole, wherein the hermetic cover includes an outer periphery of a size smaller than the outer periphery of the piston, with the outer periphery of the hermetic cover carrying an O-ring for abutting with the piston.

7. The pumping device of claim 6 further comprising a guide bolt attached to the hermetic cover, with the piston slideably received on the guide bolt.

8. In a reciprocal driving device including a drive chamber having an inlet for receiving compressed air and a vent hole, a piston unit reciprocally mounted in the drive chamber intermediate the inlet and the vent hole, with the piston unit including an outside having first and second oil seals in sliding contact with the drive chamber and a recess intermediate the first and second oil seals, and a groove in the driving chamber and having a slightly larger width than the first and second oil seals, an improvement comprising, in combination: a plurality of screw holes in the drive chamber, with each of the plurality of screw holes including a screw having an arched end, with the arched ends of the screws defining the groove in the driving chamber.

* * * * *